US005268826A

United States Patent [19]

Greene

[11] Patent Number: 5,268,826

[45] Date of Patent: Dec. 7, 1993

[54] NECK SUPPORTED FLASHLIGHT APPARATUS

[76] Inventor: Roger W. Greene, 3316 S. 128th East Ave., Tulsa, Okla. 74146

[21] Appl. No.: 44,766

[22] Filed: Apr. 12, 1993

[51] Int. Cl.[5] ..... F21L 15/08

[52] U.S. Cl. ..... 362/103; 362/183; 362/191; 362/802

[58] Field of Search ..... 362/103, 105, 108, 191, 362/382, 396, 802, 183

[56] References Cited

U.S. PATENT DOCUMENTS 1,360,988 11/1920 Potstada ..... 362/103 X
3,731,084 5/1973 Trevorrow ..... 362/108
5,063,483 11/1991 Feilmeier et al. ..... 362/103

*Primary Examiner*—Stephen F. Husar
*Attorney, Agent, or Firm*—Leon Gilden

[57] ABSTRACT

A semi-annular band formed of shape-retentive material is arranged for positioning about an individual's neck, having its first end secured to a photo-cell and its second end mounting a flashlight member thereon, whereupon the photo-cell permits actuation of the flashlight member upon entering areas of limited available light.

7 Claims, 5 Drawing Sheets

NECK SUPPORTED FLASHLIGHT APPARATUS

BACKGROUND OF THE INVENTION

1. Field of the Invention

The field of invention relates to flashlight apparatus, and more particularly pertains to a new and improved neck supported flashlight apparatus wherein the same is arranged for mounting about an individual's neck.

2. Description of the Prior Art

Flashlights of various types are utilized throughout the prior art, wherein flashlights that are garment supported are indicated in U.S. Pat. Nos. 4,970,631; 4,887,194; 4,797,793; 4,234,910; and 4,967,323.

The instant invention attempts to overcome deficiencies of the prior art by employing a photo-cell structure in cooperation with the flashlight member, wherein during support of the flashlight structure, such as in medical environments where individuals are directed into areas of limited available light, the flashlight is arranged for actuation and in this respect, the present invention substantially fulfills this need.

SUMMARY OF THE INVENTION

In view of the foregoing disadvantages inherent in the known types of flashlight apparatus now present in the prior art, the present invention provides a neck supported flashlight apparatus wherein the same is directed to the actuation upon individuals entering areas of limited available light. As such, the general purpose of the present invention, which will be described subsequently in greater detail, is to provide a new and improved neck supported flashlight apparatus which has all the advantages of the prior art body supported flashlight apparatus and none of the disadvantages.

To attain this, the present invention provides a semi-annular band formed of shape-retentent material arranged for positioning about an individual's neck, having its first end secured to a photo-cell and its second end mounting a flashlight member thereon, whereupon the photo-cell permits actuation of the flashlight member upon entering areas of limited available light.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved neck supported flashlight apparatus which has all the advantages of the prior art flashlight apparatus and none of the disadvantages.

It is another object of the present invention to provide a new and improved neck supported flashlight apparatus which may be easily and efficiently manufactured and marketed.

It is a further object of the present invention to provide a new and improved neck supported flashlight apparatus which is of a durable and reliable construction.

An even further object of the present invention is to provide a new and improved neck supported flashlight apparatus which is susceptible of a low cost of manufacture with regard to both materials and labor, and which accordingly is then susceptible of low prices of sale to the consuming public, thereby making such neck supported flashlight apparatus economically available to the buying public.

Still yet another object of the present invention is to provide a new and improved neck supported flashlight apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
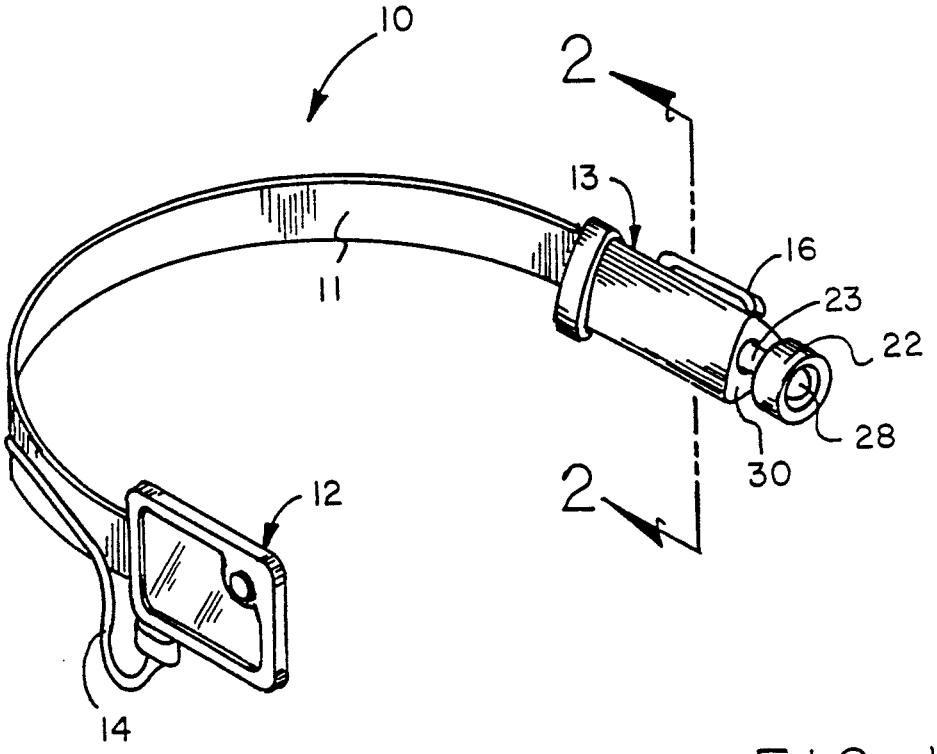
FIG. 1 is an isometric illustration of the invention.
Figure 2:
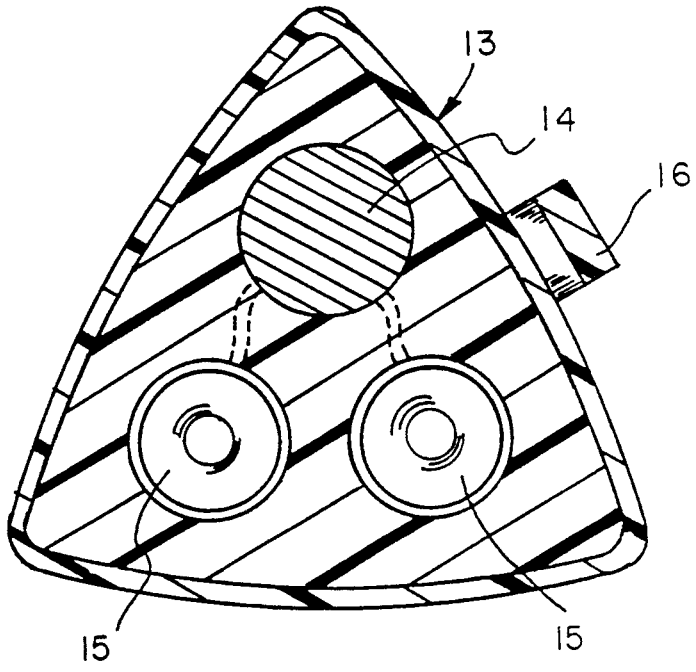
FIG. 2 is an orthographic view, taken along the lines 2—2 of FIG. 1 in the direction indicated by the arrows.
Figure 3:
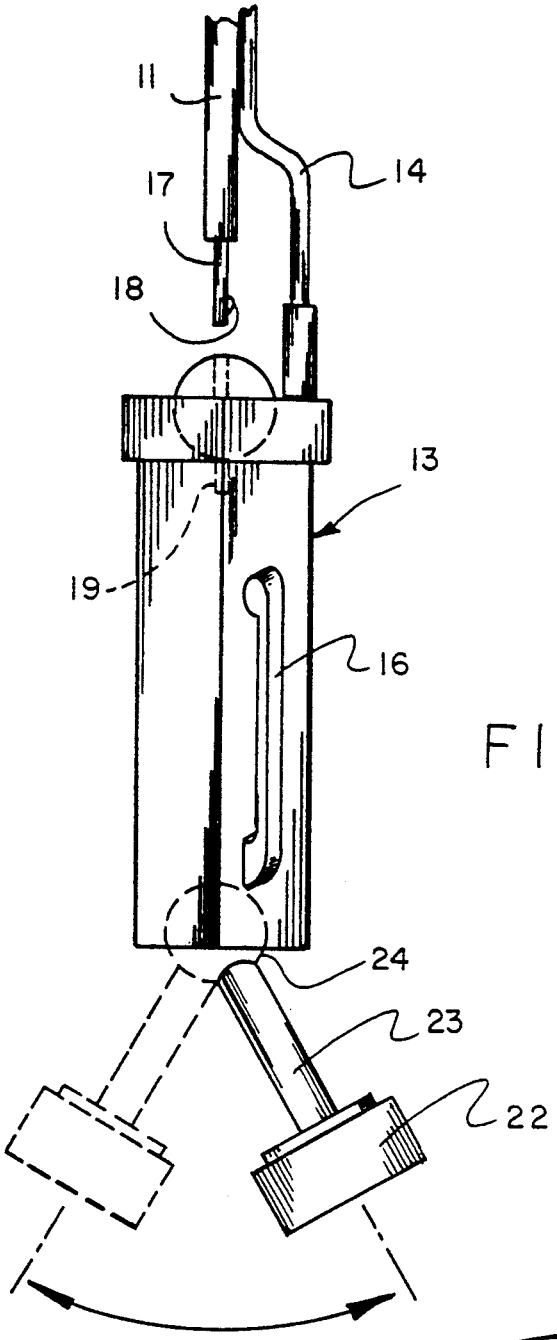
FIG. 3 is an orthographic top view of the flashlight housing mounted to the band.
Figure 4:
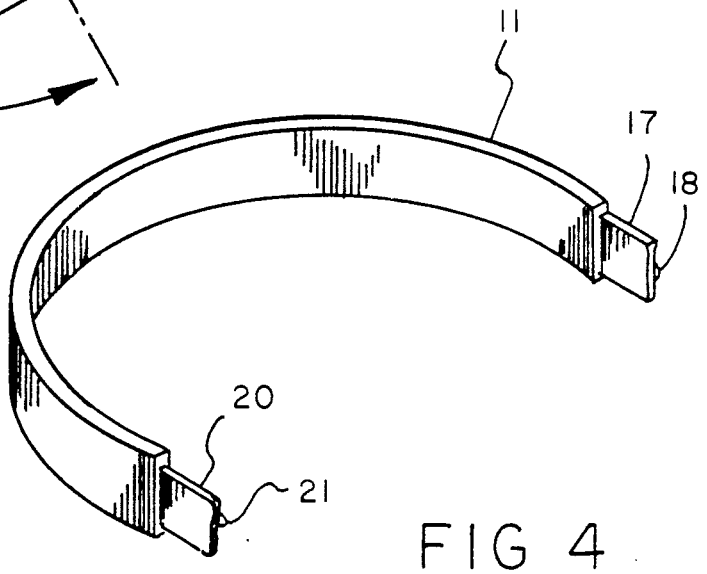
FIG. 4 is an isometric illustration of the band structure.

With reference now to the drawings, and in particular to FIGS. 1 to 10 thereof, a new and improved neck supported flashlight apparatus embodying the principles and concepts of the present invention and generally designated by the reference numeral 10 will be described.

More specifically, the neck supported flashlight apparatus 10 of the instant invention essentially comprises a semi-annular band 11 formed of a shape-retentive material arranged to maintain the semi-annular configuration to accommodate positioning about an individual's neck, wherein a photo-cell switch plate 12 is mounted to a first end of the band 11, with a flashlight housing 13 mounted to a second end of the band 11. A battery cable 14 mounted to the concave exterior surface of the band extends in electrical communication between the photo-cell switch plate 12 and the flashlight housing 13, wherein a plurality of battery members 15 are operative through actuation of the photo-cell switching structure to effect illumination within the flashlight head 22 by the illumination bulb 28. The housing 13 is indicated of a generally triangular configuration, but it is understood may be of a cylindrical or any desired configuration for enhanced use relative to an individual's neck during use. A spring clip 16 is mounted to an exterior surface of the housing 13 permitting securement of the housing to an individual's garment, such as a collar and the like. A band second end latch plate 17 having a first ball detent 18 is arranged for securement within the flashlight housing rear wall within a latch cavity 19 complementarily receiving the second end latch plate 17. The band first end latch plate 20 having a second ball detent 21 is removably mounted within the photo-cell switch plate 12. The flashlight head 22, as noted above, includes a support shaft 23 mounted pivotally to the flashlight housing front wall 30 by a support shaft ball 24 received within the housing socket permitting pivoting of the flashlight head 22 relative to the housing 13.

Figure 5:
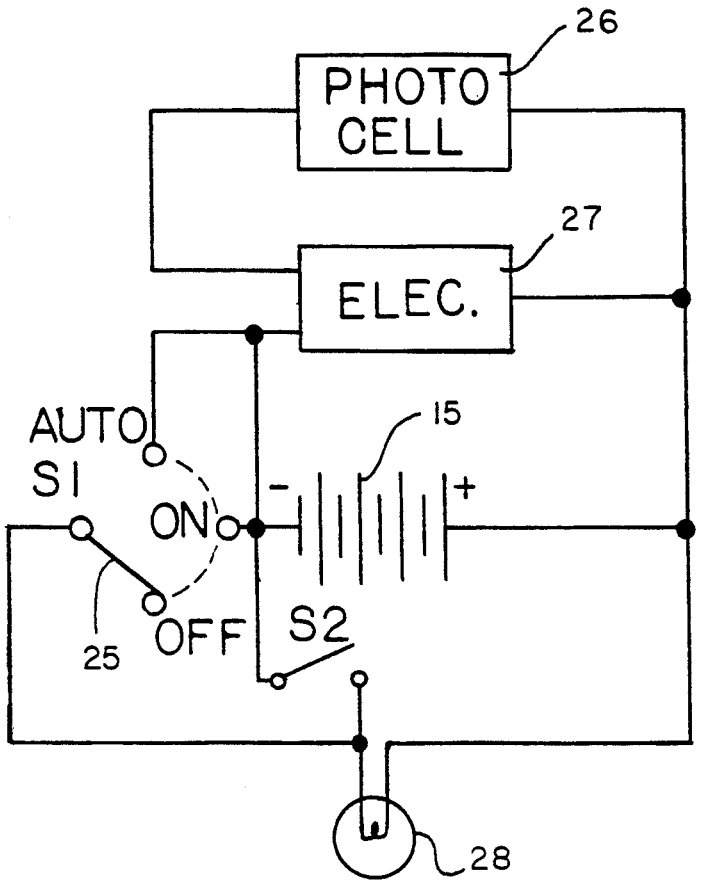
FIG. 5 is a diagrammatic electrical illustration of the invention.
Figure 6:
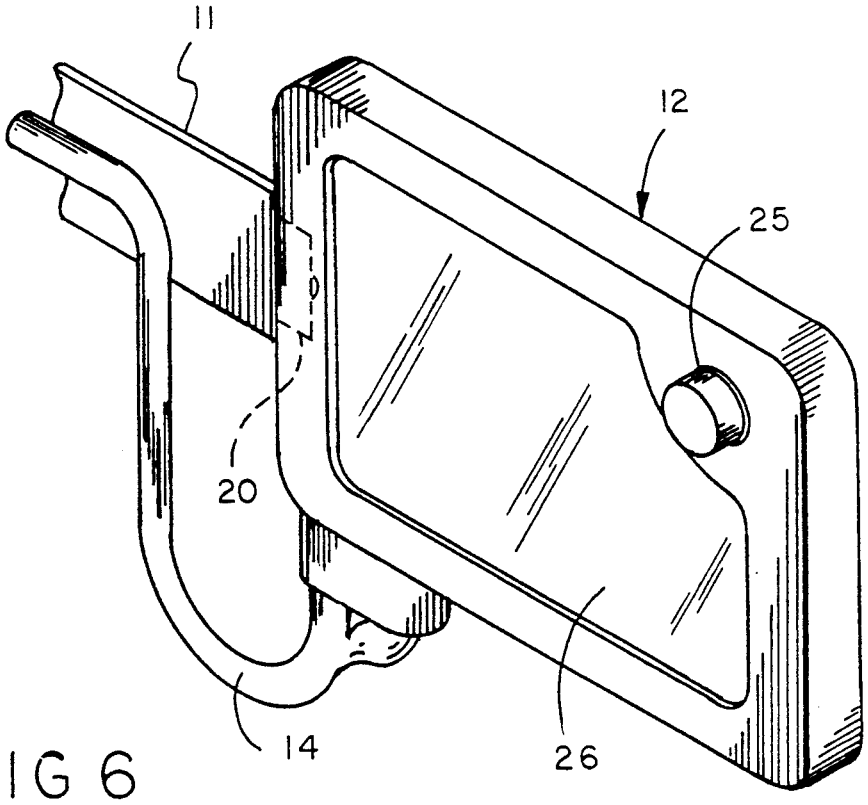
FIG. 6 is an isometric illustration of the photo-cell structure and enlarged view of the three-way switch associated therewith.

The FIGS. 5 and 6 indicate the cooperative association of the photo-cell switch 25 of a three-way switch construction arranged to effect actuation of the illumination bulb 28 and illumination thereof, or alternatively permit actuation sensitive to absence of available light, or may be switched to an off position, as indicated in FIG. 5. The photo-cell panel 26 is arranged in electrical communication with the photo-cell control circuit 27, as indicated in FIG. 5, through the battery structure 15.

Figure 7:
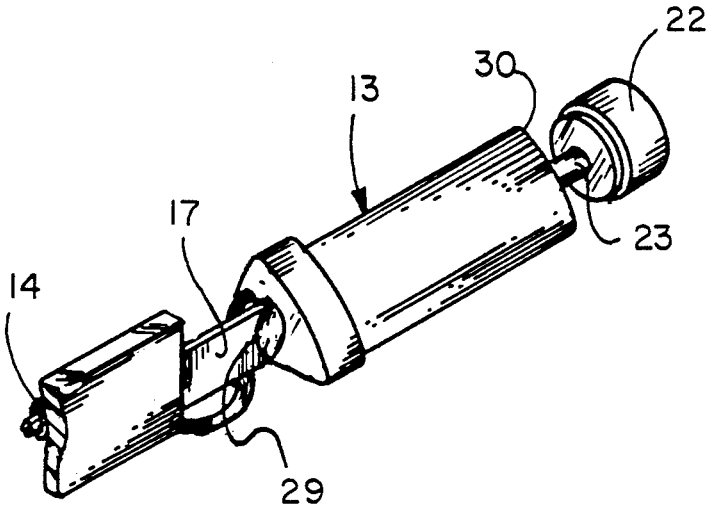
FIG. 7 is an isometric illustration of the flashlight housing arranged to employ a swivel joint mounting the band to the flashlight housing.

The FIG. 7 indicates the use of a flashlight housing spherical rear wall socket 29 to receive the second end latch plate 17 to permit pivotal mounting of the housing 13 relative to the band 11.

Figure 8:
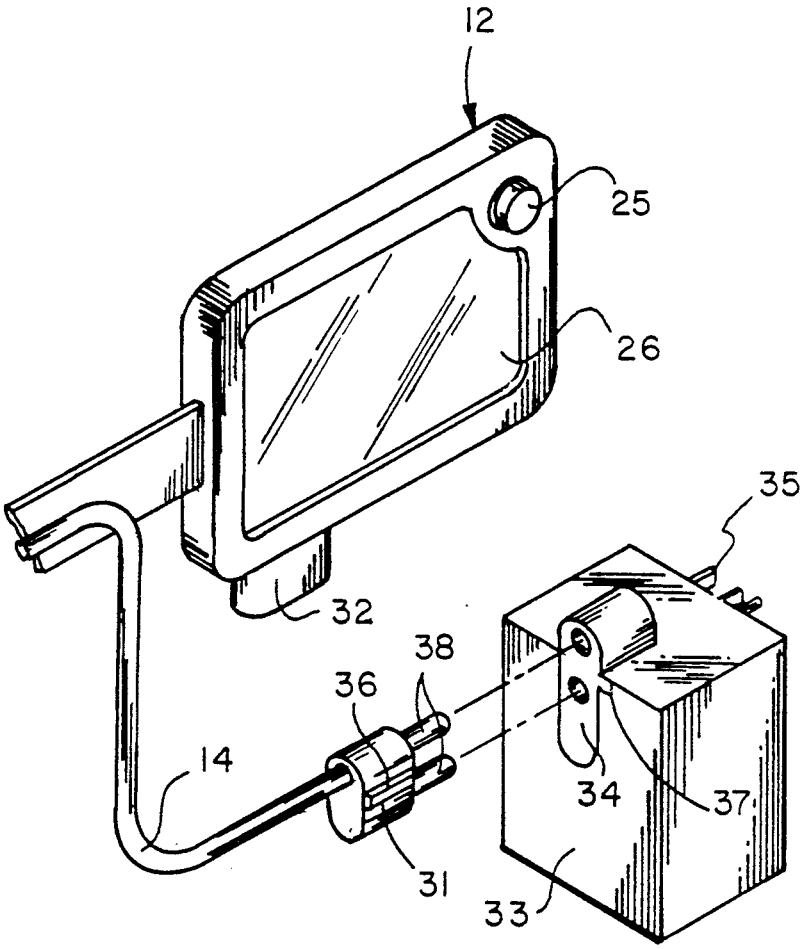
FIG. 8 is an isometric illustration of the invention employing a battery recharger.
Figure 9:
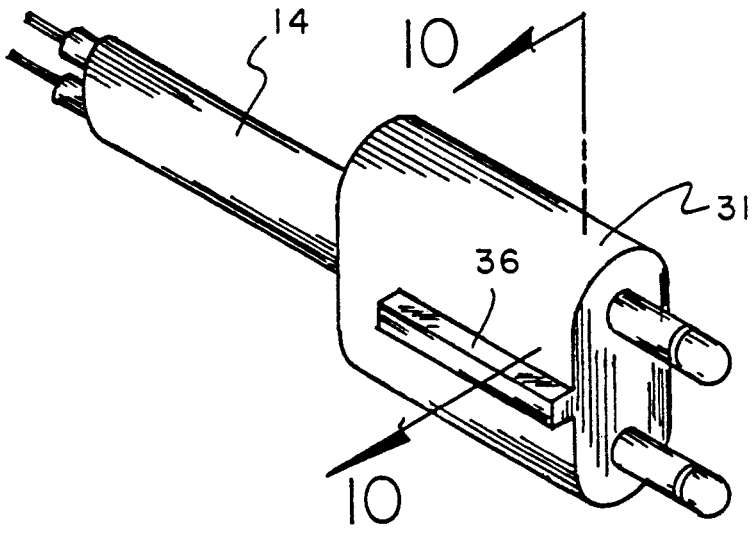
FIG. 9 is an enlarged isometric illustration of the battery cable plug member.
Figure 10:
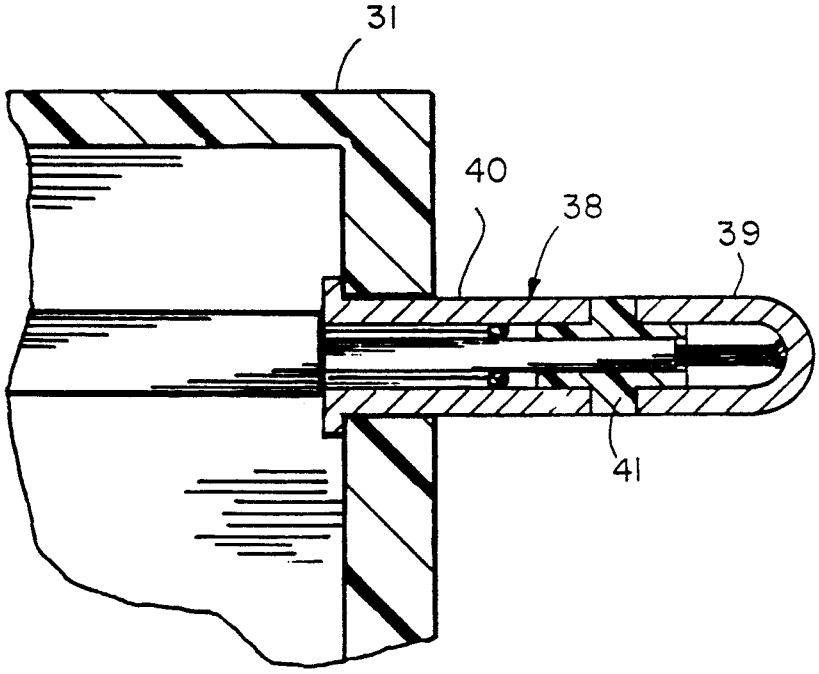
FIG. 10 is an orthographic view, taken along the lines 10—10 of FIG. 9 in the direction indicated by the arrows.

The FIG. 8 indicates the use of the battery recharge housing 33, having a plug receiving socket 34 arranged to receive a battery cable plug member 31 of the battery cable 14 to permit recharge of the permanent batteries 15 within the housing 13. An alternating current plug member 35 is mounted to the recharge housing 33 for electrical communication with a convenient available electrical outlet. The socket 34 includes a keyway slot 37 arranged to receive a cable plug rib 36 to provide for desired polarity directed for recharging of the batteries 15, with the rib further illustrated in FIG. 9. Each of the plug prongs 38 directed into the battery cable plug member 31 includes a prong tip 39 arranged for pivotal mounting relative to a prong base 40 through a flexible hinge 41 interconnecting the prong tip 39 to the base 40 preventing inadvertent damage to the prong structure 38 during projection within the recharge housing plug receiving socket 34.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A neck supported flashlight apparatus, comprising, a semi-annular band formed of a shape-retentive material, having a band first end and a band second end, with the band first end including a photo-cell switch plate, and the band second end including a flashlight housing, and a battery cable in electrical communication between the photo-cell switch plate and the flashlight housing, with the flashlight housing including a housing front wall spaced from the band first end, and the housing front wall including a pivotal ball mounted within the housing front wall, and a support shaft extending from the pivotal ball, and a flashlight head mounted to the support shaft, wherein the flashlight shaft includes an illumination bulb and at least one battery member mounted within the flashlight housing in electrical communication with the photo-cell switch plate to effect selective actuation of the illumination bulb.

2. An apparatus as set forth in claim 1 wherein the semi-annular band includes a convex exterior surface, and a battery cable having a cable first end secured to the photo-cell switch plate and directed along the convex exterior wall, and the cable having a cable second end directed into the flashlight housing in electrical communication with the at least one battery member therewithin.

3. An apparatus as set forth in claim 2 wherein the battery housing includes a spring clip mounted thereon for attaching the battery housing to a garment.

4. An apparatus as set forth in claim 3 wherein the band first end includes a first end latch plate arranged for reception within the flashlight housing rear wall, and the flashlight housing rear wall includes a spherical rear wall socket to permit pivotal mounting of the flashlight housing to the semi-annular band, and the band having a band second end latch plate arranged for reception within the photo-cell switch plate.

5. An apparatus as set forth in claim 4 wherein the photo-cell switch plate includes a three-way switch arranged to permit selective actuation of the illumination bulb sensitive to limited available light or deactivation of the photo-cell switch plate, or selective illumination of the illumination bulb through the at least one battery member.

6. An apparatus as set forth in claim 5 wherein the battery cable first end includes a battery cable plug member, and the switch plate includes a switch plate electrical socket, wherein the battery cable plug member is arranged for separation relative to switch plate electrical socket, and further including a battery recharge housing arranged for receiving the battery cable plug member, wherein the battery recharge housing includes a plug receiving socket having a keyway slot, and the battery cable plug member includes a cable plug rib arranged for complementary reception within the keyway slot to maintain polarity in recharging of the at least one battery through the battery cable.

7. An apparatus as set forth in claim 6 wherein the battery cable plug member includes a plurality of prong members received within the recharge housing plug receiving socket, wherein each of the prong members includes a prong base fixedly mounted to the battery cable plug member, and a prong tip, wherein the prong tip is separated and hingedly mounted relative to the prong base, including a resilient flexible hinge structure.

* * * * *